US006113148A

United States Patent [19]

Koranda et al.

[11] Patent Number: 6,113,148

[45] Date of Patent: Sep. 5, 2000

[54] SHOPPING REMINDER SYSTEM

[76] Inventors: William J. Koranda, 315 Fulton St., Seymour, Wis. 54165; Jeanne M. Koranda, 914 Mayfair Ave., Madison, Wis. 53714

[21] Appl. No.: 09/417,912

[22] Filed: Oct. 13, 1999

Related U.S. Application Data

[60] Provisional application No. 60/110,880, Dec. 4, 1998.

[51] Int. Cl.[7] ..... B42D 15/00

[52] U.S. Cl. ..... 283/81; 283/56; 283/79; 283/101

[58] Field of Search ..... 283/81, 79, 80, 283/101, 105, 56; 40/71, 299, 638

[56] References Cited

U.S. PATENT DOCUMENTS

| | | | |
|---|---|---|---|
| 3,537,198 | 11/1970 | Barrett . | |
| 3,769,720 | 11/1973 | Terrones . | |
| 3,916,547 | 11/1975 | Ryder . | |
| 4,026,050 | 5/1977 | Boles . | |
| 4,817,320 | 4/1989 | Fraynd . | |
| 5,004,270 | 4/1991 | Schaul et al. . | |
| 5,253,441 | 10/1993 | Rachiele et al. . | |
| 5,350,197 | 9/1994 | Schmidt . | |
| 5,676,401 | 10/1997 | Witkowksi et al. | 283/81 |
| 5,758,440 | 6/1998 | Yudin | 283/81 X |
| 5,788,284 | 8/1998 | Hirst | 283/81 |
| 5,824,790 | 11/1998 | Phillips | 283/81 X |

FOREIGN PATENT DOCUMENTS

| | | |
|---|---|---|
| 1 364 469 | 8/1974 | United Kingdom . |
| 2 160 000 | 12/1985 | United Kingdom . |

*Primary Examiner*—Willmon Fridie, Jr.
*Attorney, Agent, or Firm*—Richard C. Litman

[57] ABSTRACT

A shopping reminder system which includes a label having an indicator element or sticker that is affixed to, and essentially a miniature replica of, a product label. The sticker is intended to be peeled from the label and attached to a shopping list. The indicator element bears the image, or indicia, of the consumer product to which it is affixed, and preferably has a non-drying adhesive backing that makes the indicator element removable, transferable, and reusable. Since the indicator element bears the exact image of the consumer product represented, this device enables a consumer to readily determine and consistently obtain the exact type of product needing replenishment. A method of using the shopping reminder system is also described.

6 Claims, 2 Drawing Sheets

SHOPPING REMINDER SYSTEM

CROSS-REFERENCE TO RELATED APPLICATION

This application claims the benefit of U.S. Provisional Patent Application Serial No. 60/110,880, filed Dec. 4, 1998.

BACKGROUND OF THE INVENTION

1. Field of the Invention

The present invention relates to a shopping reminder system and more particularly to a removable indicator element bearing the image of a product to be purchased.

2. Description of Related Art

With the multitude of products on the market for a consumer to select, consumers have had the increasingly difficult task of replacing a product once its supply has run out. Even many products from the same manufacturer have varied designations such as "new," "improved," "extra strength" and the like, which compound consumer confusion. Additionally, manufacturers desire to maintain brand loyalty, which is difficult because of the wide variety of brands on the market today.

U.S. Pat. No. 3,537,198, which issued to D. C. Barrett on Nov. 3, 1970, discloses an electric shopping reminder having an intermittently rotatable drum with a series of illuminable product signs thereon. The device is displayed in retail stores to remind shoppers to purchase certain retail products.

U.S. Pat. No. 3,769,720, which issued to C. Terrones on Nov. 6, 1973, discloses an educational teaching board to teach food nutrition to children. The game comprises a magnetic board and a plurality of complementary magnetic pieces that are in the shape of a type of food.

U.S. Pat. No. 3,916,547, which issued to F. E. Ryder on Nov. 4, 1975, discloses a visual reminder device for displaying a variety of tasks to be performed. The device has a plurality of tabs that correspond to a respective task. When a task is completed the tab is moved to indicate completion.

U.S. Pat. No. 4,817,320, which issued to L. S. Fraynd on Apr. 4, 1989, discloses a shopper's reminder system for the replenishment of household products. The system provides a first list for displaying categories of products in adequate supply, and a second list for displaying categories of products requiring replenishment. A plurality of magnetic indicator elements are provided and are transferable between the two lists, thereby indicating when a certain product is in stock or is in short supply.

U.S. Pat. No. 4,026,050, which issued to B. A. Boles on May 31, 1977, discloses a grocery shopping reminder having two book cover members having raised boundary portions that house a plurality of rods on which slide elongated parallelepiped indicator slides having grocery items individually listed thereon. The indicator slides are slidable to either of two positions, one position indicating that a grocery item is needed, another position indicating that a grocery item is not needed.

U.S. Pat. No. 5,004,270, which issued to Schaul et al. on Apr. 2, 1991, discloses a buying guide that is attached to a magazine or newspaper insert. The invention includes a checklist with indicators to note and organize an inventory of shopping items and coupons from the accompanying magazine or newspaper insert. Pouches are also included for holding coupons.

U.S. Pat. No. 5,253,441, which issued to Rachiele et al. on Oct. 19, 1993, discloses a device for listing and marking items and errands that includes a planar support sheet and plate displaying an itemized shopping list attached thereto. Indicia representing items are sequentially arranged upon the support sheet along with visual markers having a respective cover tab. When uncovered, the indicia call attention to a needed item.

U.S. Pat. No. 5,350,197, which issued to S. A. Schmidt on Sep. 27, 1994, discloses a shopping list and discount coupon correlator. The invention has a pouch for holding discount coupons, whereupon the shopper checks off a box on the list.

U.K. Patent No. 2,160,000 published Dec. 11, 1985 and invented by E. P. Roche is a shopping list system in the form of a plaque which is not attached to a product label.

U.K. Patent No. 1,364,469 published Aug. 21, 1974 and invented by D. M. Bruce is a plastic coated wooden sign with removable letters used for displaying and advertising.

None of the above inventions and patents, taken either singly or in combination, is seen to describe the instant invention as claimed.

SUMMARY OF THE INVENTION

The present invention is a shopping reminder system for use by consumers when replenishment of a consumer product is desired. The system comprises a label affixed to a consumer product, and an indicator element removably affixed to the label. The indicator element is a miniature replica of the label. It can be peeled off of the label, and reapplied to the same or other smooth surface, e.g. a shopping list, without any appreciable loss in adhesion.

Since the indicator element bears the exact image of the representative consumer product, shoppers, especially the young, elderly, foreign language-speaking and illiterate, may more easily determine the exact type of product needed by matching the indicator element with the product label in a store. From the standpoint of the manufacturer, the indicator element encourages and facilitates repetitive purchases by consumers of the same exact product, thus ensuring brand loyalty on the part of the consumer. From the consumer's standpoint, the indicator element gives the elderly, disabled, etc., the ability to have their choice product selected by them, their friend or assistant without mistake.

It is therefore desirable to have a shopping reminder system having all of the benefits and none of the drawbacks of the related art.

Accordingly, it is a principal object of the invention to provide a shopping reminder system that enables a consumer to easily ascertain the exact type of product desired.

It is another object of the invention to provide a shopping reminder system that may be easily and inexpensively manufactured, marketed and implemented.

It is a further object of the invention to provide a shopping reminder system that helps ensure brand loyalty in consumers.

Still another object of the invention is to provide a shopping reminder system that may easily and conveniently used by consumers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
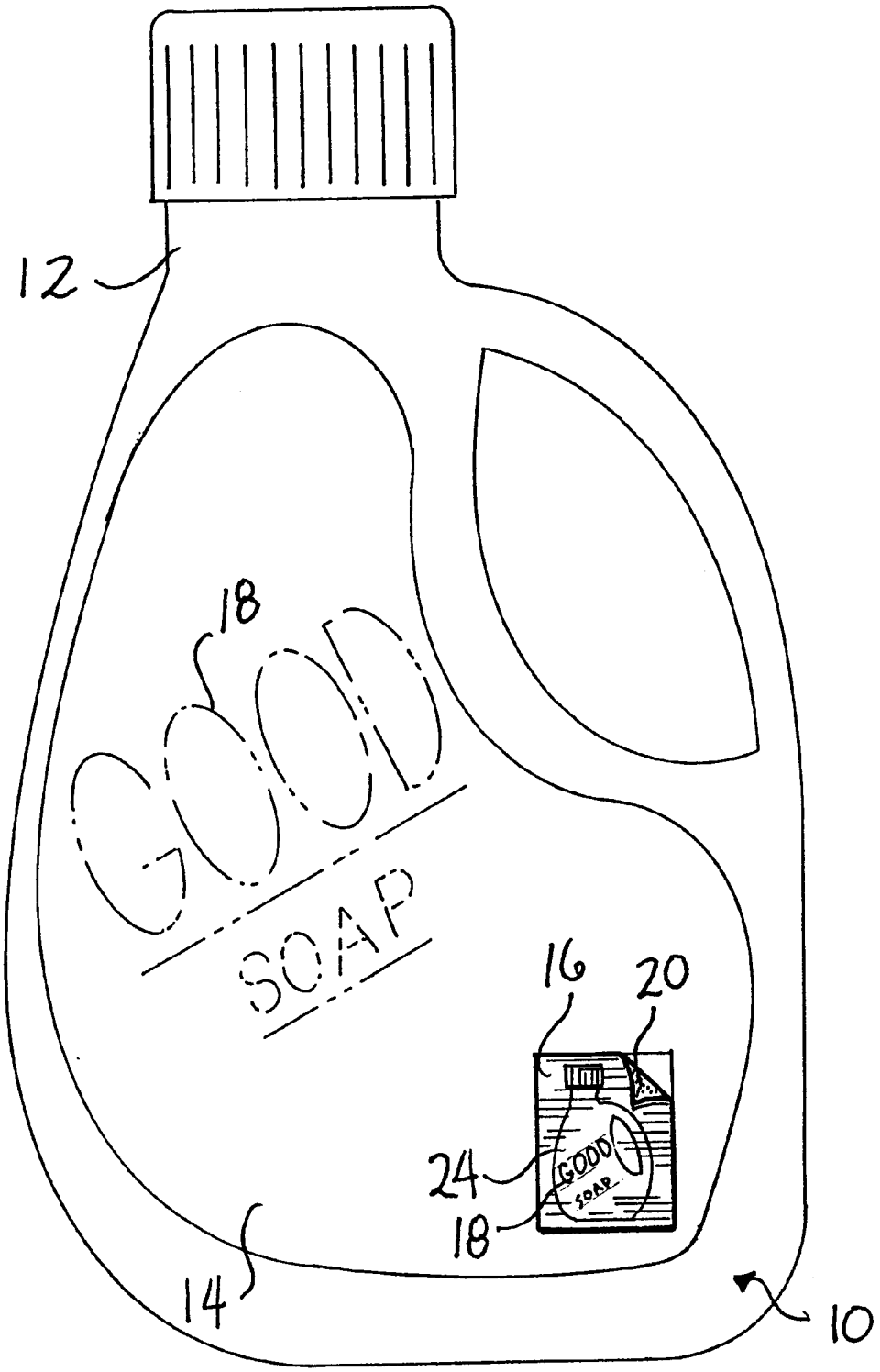
FIG. 1 is an environmental, front elevational view of a shopping reminder system according to the present invention, shown in use on a soap bottle.

Referring now to the drawings, wherein like numerals represent like elements, FIG. 1 shows a shopping reminder system 10 affixed to a consumer product 12 such as a soap bottle, although in other embodiments the system may be used on a great variety of consumer products such as coffee cans, snack food containers, disposable diaper containers, beverage bottles and cans, and the like. The system 10 comprises a label 14 and a planar indicator element 16. The label 14 is permanently affixed to the consumer product 12, and may be made of any suitable material or material composite used in making food product labels. Indicator element 16 is removably affixed to label 14. For purposes of this invention, "removably affixed" means that element 16 may be peeled, by hand, off of label 14 without damaging element 16 or label 14. Indicator element 16 bears brand identifying indicia 18 such as the brand name of the product and/or a trademark of the product and/or an image of the product or an image of the product label. Element 16 may appear as a miniature replica of the product label 14, to which it is attached. Finally, element 16 may contain braille markings indicating the type of product, the brand name, and other identifying features of the product and/or product label so as to accommodate the visually impaired. In the case of bulk goods (dry dog food, for example), label 14 is affixed to a card enclosed with the product, near the reorder point.

Figure 2:
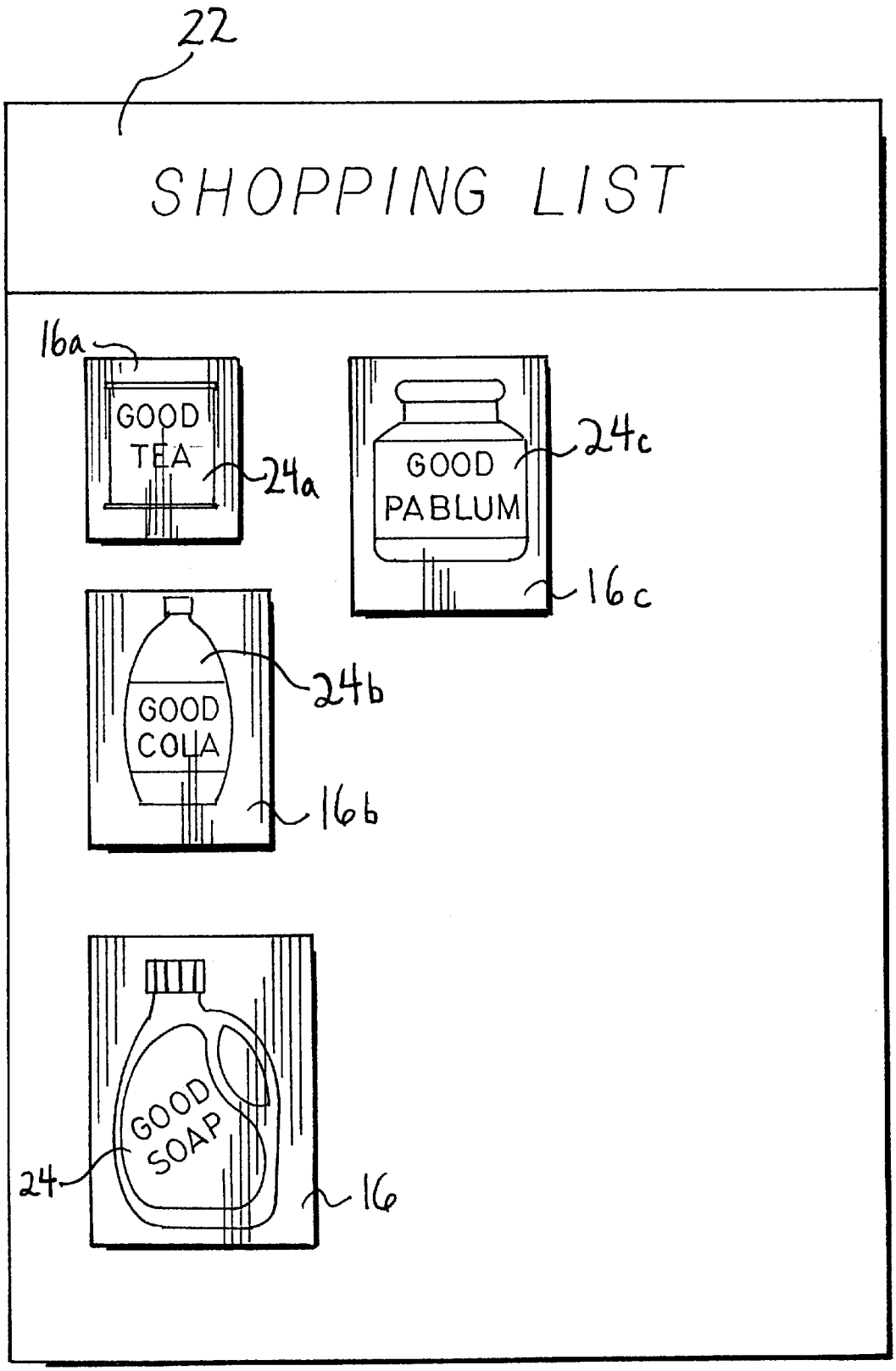
FIG. 2 is an environmental, front elevational view of the indicator element of the shopping reminder system, shown affixed to a shopping list.

As shown in FIG. 1, indicator element 16 bears image 24 identical to that of consumer product 12, including brand identifying indicia 18. Indicator element 16 additionally is removably and adhesively mounted to label 14 of consumer product 12. This may be accomplished with a non-drying adhesive backing 20. For purposes of this invention, "non-drying adhesive" means that element 16 may be removed from label 14 without any appreciable loss in the adhesive quality of element 16, such that element 16 may be reused and reapplied to any smooth paper or plastic product, shopping list, or the like. In the alternative, other methods may be used to make element 16 removably adhere to label 14, such as surface tension (i.e., analogous to the attraction between two plates of glass), magnetic attraction (for metal cans), and other commonly known methods for adhering one smooth planar surface to another. Adhesive backing 20 allows element 16 to be removably mounted to a wide variety of surfaces, including but not limited to shopping lists 22 (one of which is shown in FIG. 2), refrigerators, mirrors, cabinets, walls, light switches, washing machines, televisions, and doors. Element 16 is preferably made from a thin layer of paper product with a layer of non-drying type adhesive, comparable to the adhesive used by 3M on "Post-it Notes" (TM) . In any case, the adhesive on indicator element 16 shall maintain physical qualities such that it remains active, i.e. without any appreciable loss in adhesive capabilities, when element 16 is transferred from surface to surface over a series of at least three such transfers. Element 16 may also be made from a layer, or layers, of plastic, paper, rubber, metal, any composite of the aforementioned, or any other suitable thin, flexible material.

To use the shopping reminder system 10, a shopper removes indicator element 16 from consumer product 12 when product 12 needs to be replenished, and affixes one or more indicator elements 16, 16*a*, 16*b*, 16*c* to a shopping list 22 shown in FIG. 2. If a shopping list 22 cannot be located, adhesive backing 20 enables the shopper to temporarily stick an indicator element, such as 16, 16*a*, 16*b*, or 16*c*, to virtually any flat surface and to then transfer the elements to a shopping list when convenient.

Because each indicator element 16, 16*a*, 16*b*, 16*c* may bear an image 24, 24*a*, 24*b*, 24*c* identical to that of the corresponding consumer product 12, from which the indicator element is removed, the consumer may more easily ascertain the exact product for which replenishment is needed (e.g. "new," "improved," "extra crunchy," "maximum strength," and the like) simply by matching the indicator element 16, 16*a*, 16*b*, 16*c* with the corresponding product at the store. Additionally, young, foreign and illiterate shoppers may more easily determine which exact product is required without having to understand the label.

It is to be understood that the present invention is not limited to the sole embodiment described above, but encompasses any and all embodiments within the scope of the following claims.

What is claimed is:

1. A shopping reminder system, comprising:

a product label affixed to a consumer product; and an indicator element affixed to said label, said element having a bottom surface with an affixing means, and a top surface having indicia thereon representing said label and identifying the product; wherein said indicator element is removably affixed to said label by said affixing means;

said affixing means is adapted to removably affix said indicator element to a shopping list after removal of said indicator element from said label; and said indicia include an image imprinted on said indicator element, said image including a miniature replica of said label.

2. The shopping reminder system according to claim 1, wherein said image consists of a miniature replica of said label.

3. The shopping reminder system according to claim 1, wherein said indicia includes a representation of said label in braille.

4. The shopping reminder system according to claim 1, wherein said affixing means is an adhesive of the non-drying type such that said indicator element may be repeatedly reused.

5. The shopping reminder system according to claim 1, wherein said affixing means is of the surface tension type such that said indicator element may be repeatedly reused.

6. The shopping reminder system according to claim 1, wherein said affixing means is of the magnetic type such that said indicator element may be repeatedly reused.

* * * * *